US006153839A

United States Patent [19]

Zavracky et al.

[11] Patent Number: 6,153,839

[45] Date of Patent: Nov. 28, 2000

[54] MICROMECHANICAL SWITCHING DEVICES

[75] Inventors: Paul M. Zavracky, Norwood; Nicol E. McGruer, Dover, both of Mass.

[73] Assignee: Northeastern University, Boston, Mass.

[21] Appl. No.: 09/177,229

[22] Filed: Oct. 22, 1998

[51] Int. Cl.[7] ..... H01H 57/00

[52] U.S. Cl. ..... 200/181

[58] Field of Search ..... 73/514.16, 514.36, 73/514.37; 148/402, 563; 200/181, 259, 16 B, 16 D, 512, 61.48, 262–270; 251/275; 257/418, 419, 773, 784, 580; 310/309, 328; 330/278, 295, 307; 333/262; 334/55; 337/139, 140; 359/230; 361/233, 234; 385/16, 20

[56] References Cited

U.S. PATENT DOCUMENTS

| | | | |
|---|---|---|---|
| 2,942,077 | 6/1960 | Diesel | 200/87 |
| 4,315,114 | 2/1982 | Monti, Jr. | 200/5 A |
| 4,480,162 | 10/1984 | Greenwood | 200/181 |
| 4,570,139 | 2/1986 | Kroll | 335/187 |
| 4,868,448 | 9/1989 | Kornrumpf | 310/331 |
| 4,959,515 | 9/1990 | Zavracky et al. | 200/181 |
| 5,544,001 | 8/1996 | Ichiya et al. | 361/233 |
| 5,638,946 | 6/1997 | Zavracky | 200/181 |

*Primary Examiner*—Michael Friedhofer

*Attorney, Agent, or Firm*—Weingarten, Schurgin, Gagnebin & Hayes LLP

[57] ABSTRACT

A micromechanical switch or relay in accordance with the invention includes a substrate, a source electrode, a gate electrode, a drain electrode, and various style beams. In one embodiment the beam is relatively long and includes flexures on at least one end, and has a small activation voltage. Additional embodiments include a relay wherein the beam has an insulator and an isolated contactor wherein the interface between the beam and the insulator is more mechanically robust by having the insulator fill recesses in the end of the beam; a switch or relay wherein the drain contacts are collinear with the source contacts so that the strain gradient of the mechanical material does not affect performance of the device; a snap action switch in which the beam acts a leaf spring such that an initial voltage places the beam close to the contact, and a small additional voltage results in a large beam force for closing the switch contact; a switch or relay wherein the beam includes a hinge and is therefore more easily deflectable; and a single pole double throw switch or relay wherein the beam is deflectable in a first direction to provide a first connection and also deflectable in a second direction to provide a second connection. The switches and relays can be ganged together in order to switch high currents, and can be fabricated to have a single large beam, a single large gate contact, a single large source contact, a single large drain contact, or combinations thereof. Additionally, the switches and relays can be used to form logic circuits such as NAND gates, NOR gates, inverters and the like.

45 Claims, 10 Drawing Sheets

FIG. 10A
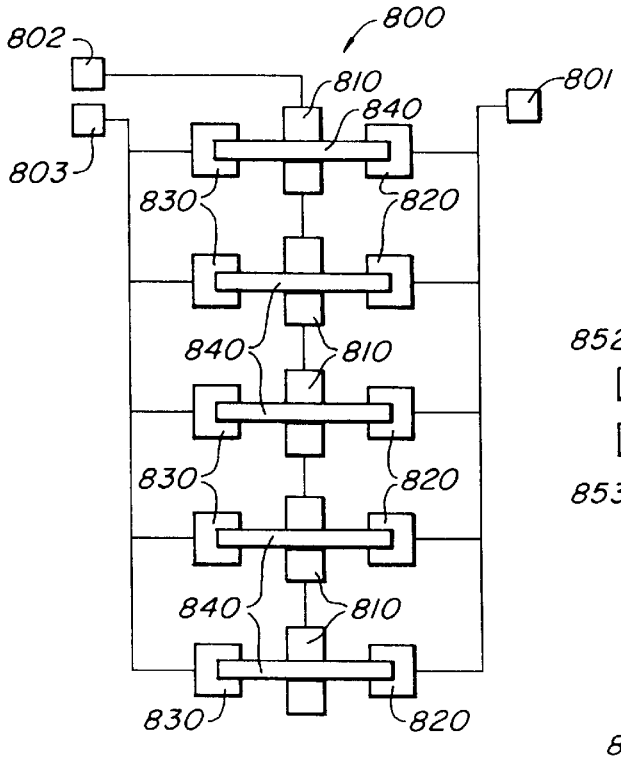
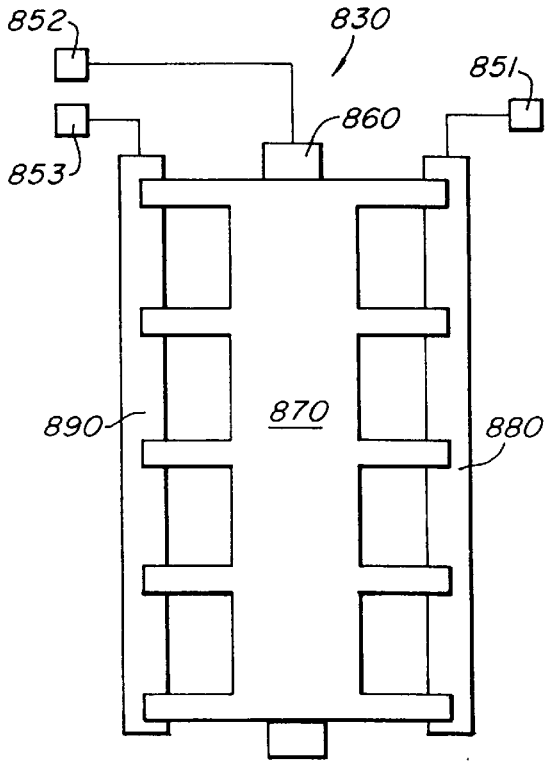
FIG. 10B
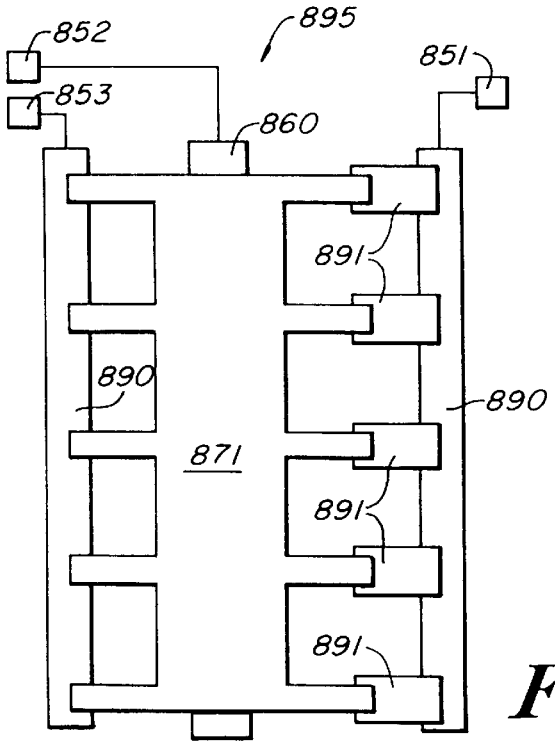
FIG. 10C

MICROMECHANICAL SWITCHING DEVICES

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

Electronic measurement and testing systems use relays and/or switches to route signals. Switching devices used in these systems are required to have a very high off-resistance and a very low on-resistance. MOS analog switches have the disadvantage of non-zero leakage current, high on-resistance and parasitic capacitance.

An example of a prior art microswitch 10 is illustrated in FIGS. 1A and 1B. The basic structure is a micromechanical switch that includes a source contact 14, a drain contact 16, and a gate contact 12. A conductive bridge structure or beam 18 is attached to the source contact 14. As shown in FIG. 1B, the bridge structure 18 overhangs the gate contact 12 and the drain contact 16 and is capable of coming into mechanical and electrical contact with the drain contact 16 when deflected downward. Once in contact with the drain contact 16, the bridge 18 permits current to flow from the source contact 14 to the drain contact 16. An electric field is applied in the space 20 by a voltage on the gate 12. With a sufficiently large field in the space 20, the switch closes and completes the circuit between the source and the drain by deflecting the bridge structure 18 downwardly to contact the drain contact 16.

Switches of this type are disclosed in U.S. Pat. No. 4,674,180 to Zavracky et al., the disclosure of which is incorporated by reference herein. In this device, a specific threshold voltage is required to deflect the bridge structure so that it may contact the drain contact. Once the bridge comes into contact with the drain contact, current flow is established between the source and the drain.

During operation, hysteresis can arise if the voltage required to draw the end of the beam into contact with the drain contact is greater than that required to hold it in contact with the drain. Thus, two modes of operation exist—a hysteretic mode and a non-hysteretic mode. In a hysteretic mode, when the switch is closed, the gap between the beam and the gate is reduced and therefore the gate voltage required to maintain the beam in its downward deflected state is less than the gate voltage required to actuate the switch. To release the beam so that the beam returns to its open state requires a reduction in the gate voltage to a level below not only the gate voltage required to deflect the beam, but also less than the gate voltage required to maintain the beam in its deflected position. A non-hysteretic mode of operation occurs when the switch has a minimum gate actuation voltage approximately equal to the maximum gate release voltage due in part to a longer beam length and larger gate area. Thus there is a particular threshold voltage, above which the beam will be deflected downward, and below which the beam will be released.

Another consideration is that the drain end of the switch may also experience an electrostatic force for high drain/source voltages. Increasing the drain/source voltage above a critical value will cause an unstable operation of the device and may deflect the beam, establishing contact between the drain and the source. This effect is the equivalent of breakdown in a solid state device.

A relay having a contact that is isolated from the beam is disclosed in U.S. Pat. No. 5,638,946 to Zavracky et al., the disclosure of which is incorporated by reference herein. Referring to FIGS. 2A and 2B a micromechanical relay 28 is shown that includes a substrate 30, and a series of contacts mounted on the substrate. The contacts include a source contact 32, a gate contact 34, and a drain contact 36. The drain contact 36 is made up of two separate contacts 37 and 37'. A beam 38 is attached at one end 40 to the source contact 32 and permits the beam to hang over the substrate. The beam is of sufficient length to overhang both the gate contact 34 and the drain contact 36. The beam 38 illustrated in FIGS. 2A and 2B includes an insulative element 42 that joins and electrically insulates the beam body 44 from the beam contact 46. In operation, actuation of the relay permits the beam contact to connect the two separate contacts 37 and 37' of the drain contact 36 and allow current to flow from one separate drain contact to the other. It has been found that the insulator to beam interface can be mechanically weak, and that the insulator may separate from the beam, resulting in failure of the device.

BRIEF SUMMARY OF THE INVENTION

A micromechanical switch or relay in accordance with the invention includes a substrate, a source electrode, a gate electrode, a drain electrode, and various style beams. In one embodiment the beam is relatively long and includes flexures on at least one end, and has a small activation voltage. Additional embodiments include a relay wherein the beam has an insulator and an isolated contactor wherein the interface between the beam and the insulator is more mechanically robust by having the insulator fill recesses in the end of the beam; a switch or relay wherein the drain contacts are collinear with the source contacts so that the strain gradient of the mechanical material does not affect performance of the device; a snap action switch in which the beam acts as a leaf spring such that an initial voltage places the beam close to the contact, and an additional voltage results in a large beam force for closing the switch contact; a switch or relay wherein the beam includes a hinge and is therefore more easily deflectable; and a single pole double throw switch or relay wherein the beam is deflectable in a first direction to provide a first connection and also deflectable in a second direction to provide a second connection. The switches and relays can be ganged together in order to switch high currents, and can be fabricated to have a single large beam, a single large gate contact, a single large source contact, a single large drain contact, or combinations thereof. Additionally, the switches and relays can be used to form logic circuits such as NAND gates, NOR gates, inverters and the like.

BRIEF DESCRIPTION OF THE SEVERAL VIEWS OF THE DRAWING

The invention will be more fully understood from the following detailed description taken in conjunction with the accompanying drawings in which:

FIG. 10A is a top view of a ganged switch;

FIG. 10B is a top view of a ganged switch having a common beam, common source, common gate, and common drain electrodes;

FIG. 10C is a top view of the ganged switch of FIG. 10B including integral resistors;

DETAILED DESCRIPTION OF THE INVENTION

An improved micromechanical switch or relay is presented. Throughout the specification the term switch is used when referencing a structure providing communication between a source electrode and a drain electrode when the device is in its active or on state, and the term relay is used when referencing a structure which provides communication between a first drain contact and a second drain contact when the device is in its active or on state. In most instances, the relay can be substituted for the switch by isolating the distal end of the beam from the beam body and by having the beam tip interconnect a pair of drain contacts when the relay is in its active or on state.

Figure 3A:
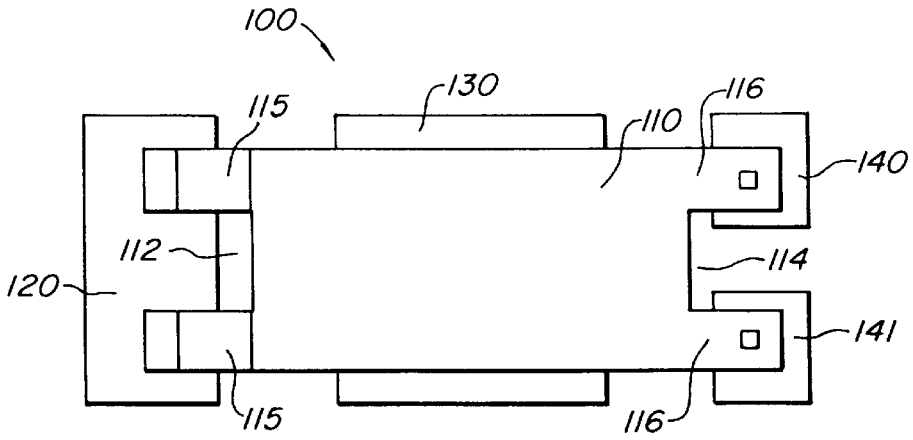
FIG. 3A is a top view of an embodiment of the present invention.
Figure 3B:
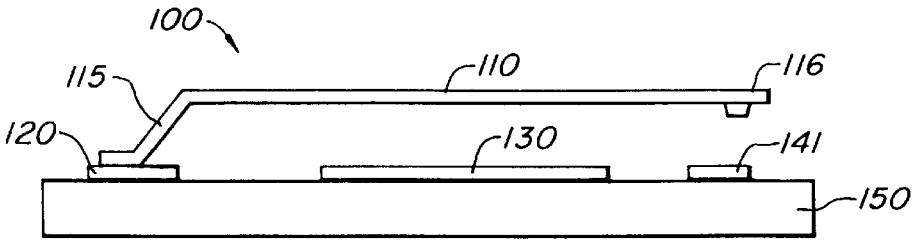
FIG. 3B is a side view of the embodiment of the invention shown in FIG. 3A.
Figure 3C:
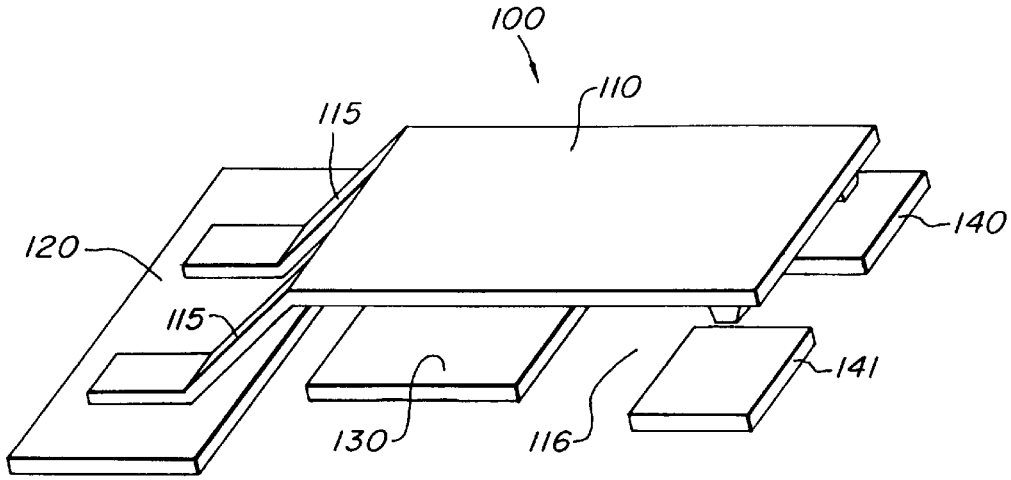
FIG. 3C is an isometric view of the micromechanical switch of FIG. 3A.

Referring to FIGS. 3A–3C, a first embodiment 100 of the switch is shown. The micromechanical switch 100 includes a modified H-shaped beam 110, a source contact 120, a gate contact 130 and a pair of drain contacts 140, 141 mounted on a substrate 150.

The beam 110 has first and second flexures 115 separated by a space 112 and each flexure having an end attached to the source contact 120. The beam also has a pair of flexures 116 on the end opposite to the mounting end, these flexures 116 separated by a space 114, and each having an end which overlies a respective drain contact 140 and 141. The beam length is determined to provide the intended switching frequency of the microrelay and in the illustrated embodiment is approximately 70 micrometers in length.

Figure 1A:
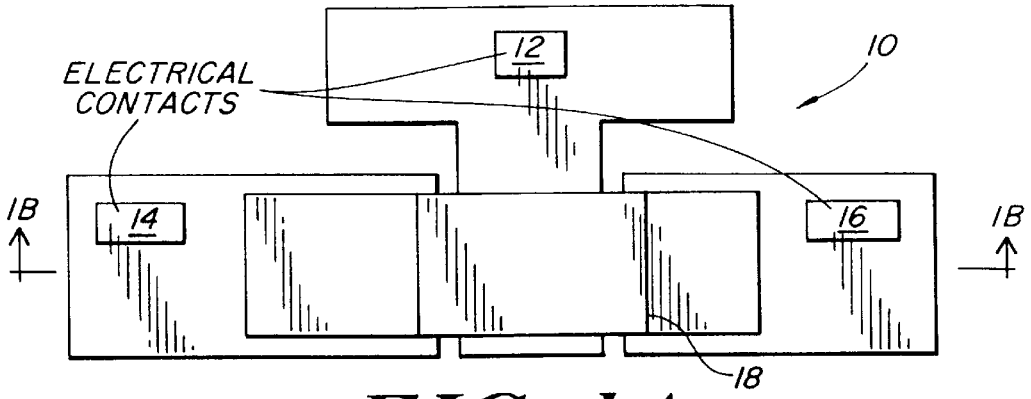
FIG. 1A (PRIOR ART)
FIG. 1A is a top view of a prior art micromechanical switch.
Figure 1B:
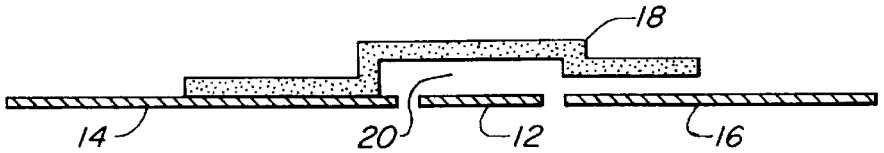
FIG. 1B (PRIOR ART)
FIG. 1B is a side view of the micromechanical switch shown in FIG. 1A cut along line 1B.
Figure 2A:
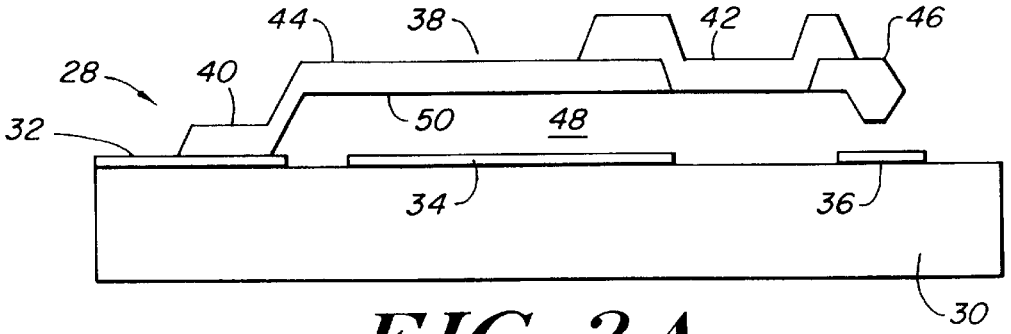
FIG. 2A (PRIOR ART)
FIG. 2A is a side view of a prior art micromechanical switch having an isolated contact.
Figure 2B:
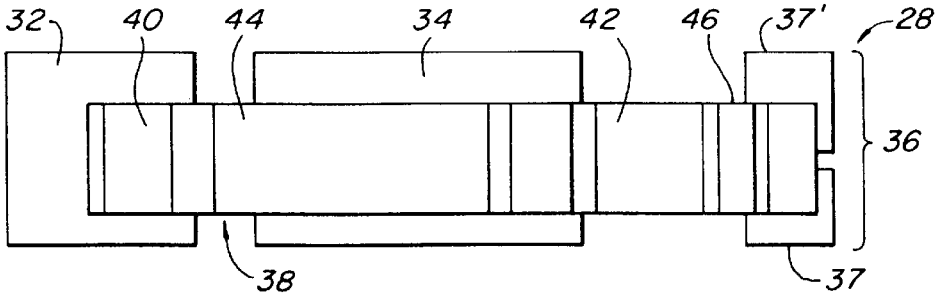
FIG. 2B (PRIOR ART)
FIG. 2B is a top view of the micromechanical switch of FIG. 2A.

30 The spaced flexures 115 and spaced flexures 116 provide a beam of relatively small mass in comparison to a conventional beam construction such as shown in FIG. 1. The spaced flexures also provide a beam which is more readily deflectable into closed and open positions by reason of the small cross section of the flexured portions of the beam. The actuation voltage of the embodiment of FIG. 3 is relatively low and is approximately ⅓ to ½ of the actuation voltage of prior art micromechanical switches such as shown in FIG. 1. While both ends of the beam are shown including flexures, it should be appreciated that a beam with flexures at only one end could also be utilized.

In one embodiment, the substrate material of the micromechanical switch of the invention may be made of glass, silicon, or other substrate known in the electrical arts. The beam material in this embodiment is preferably gold. However, other materials such as nickel, chromium, copper and/or iron may also be used.

Figure 4:
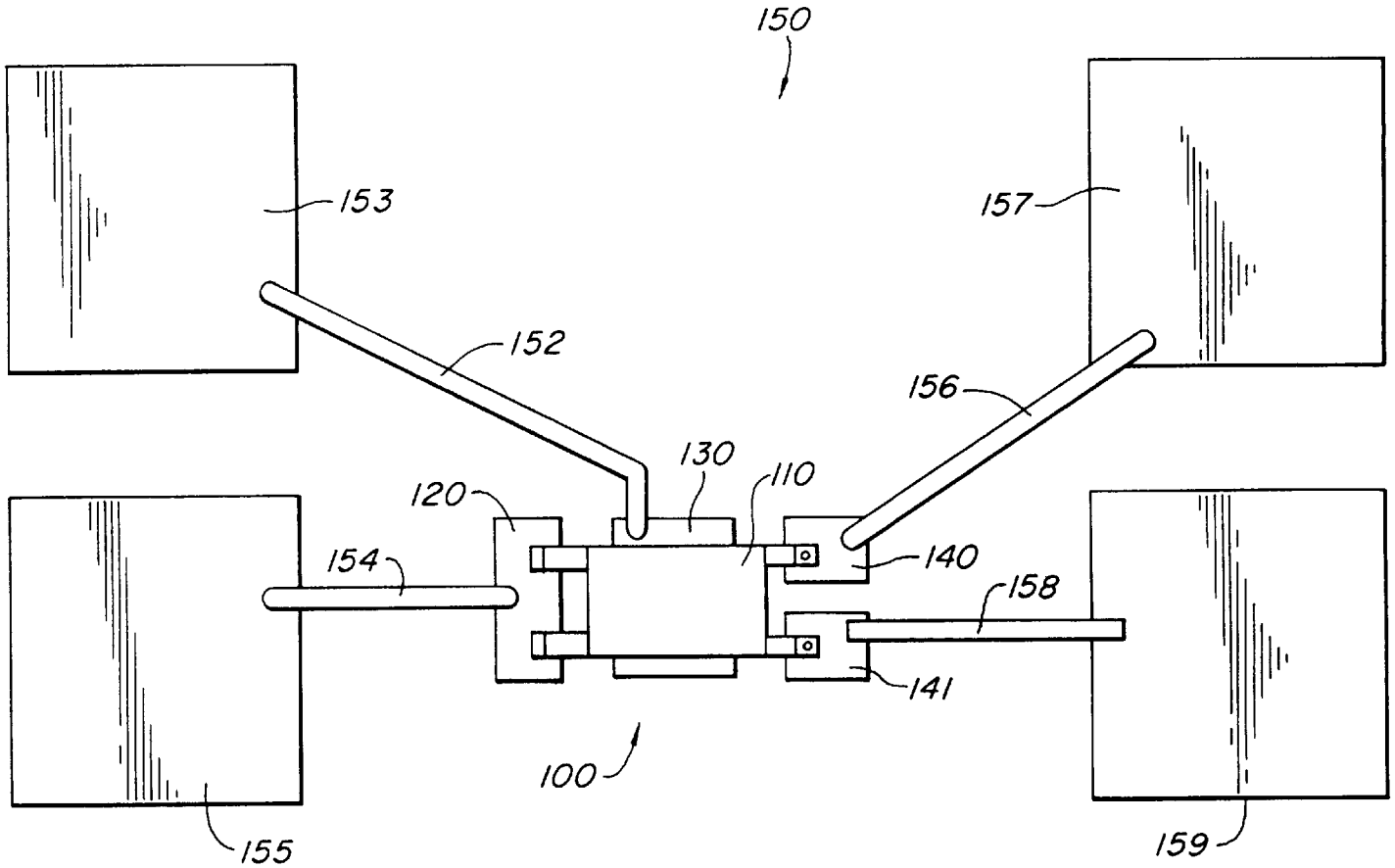
FIG. 4 is a top view of the micromechanical switch of FIG. 3A implemented in a package.

The source contact 120, gate contact 130, and drain contacts 140, 141 may be any conductive material, such as platinum, palladium, ruthenium, rhodium, gold, or other conductive metal known in the art. The contacts 120, 130 and 140, 141 may be deposited on the substrate by any method known in the art, such as sputtering, chemical vapor deposition, or the like. The switch illustrated in FIG. 3A–3C can typically be packaged in the manner illustrated in FIG. 4 for interconnection to external circuitry. Referring to FIG. 4, a substrate 150 includes bonding pads 153, 155, 157 and 159 which are interconnected by bonding wires 152, 154, 156 and 158 to respective switch contacts 130, 120, 140 and 141. The bonding pads are interconnected to external circuitry typically by bonding wires or printed circuit interconnections. Additionally, the device can be formed on a substrate which also has had transistors formed thereon, and a metallization layer is utilized to interconnect the switch to the transistor at the transistor level.

Figure 5A:
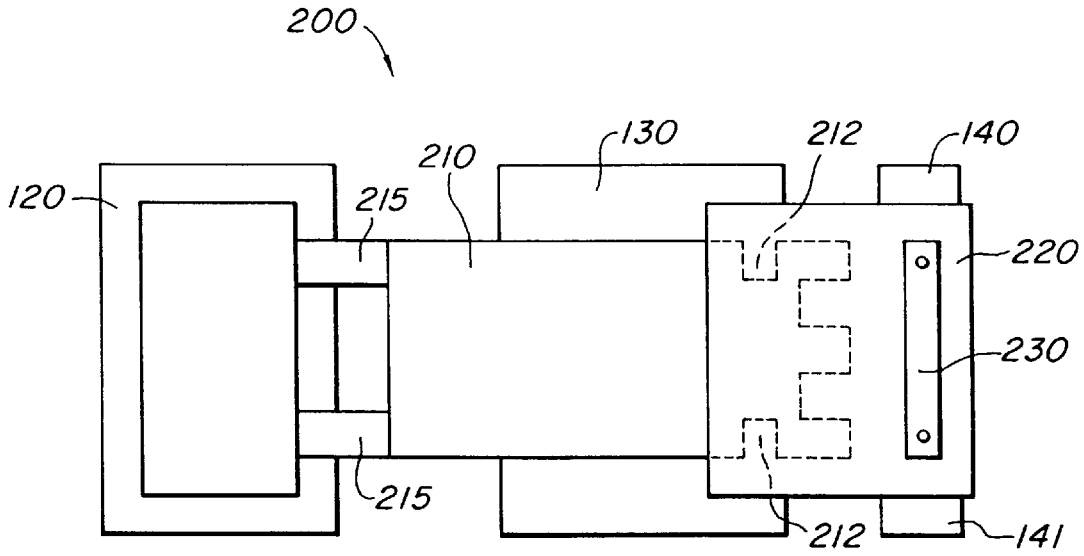
FIG. 5A is a top view of an micromechanical relay of the present invention.
Figure 5B:
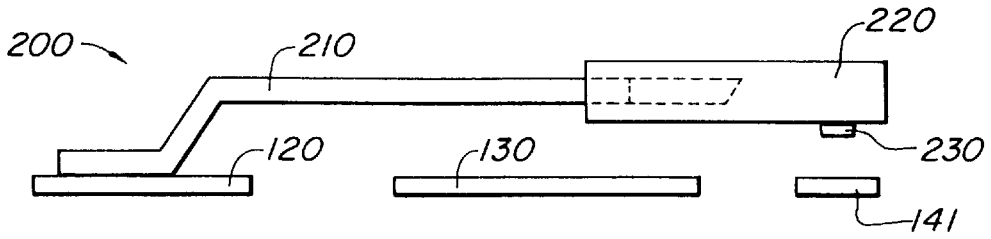
FIG. 5B is a side view of the micromechanical relay of FIG. 5A.

The invention as embodied in a micromechanical relay 200 is shown in FIGS. 5A and 5B. The relay includes a beam 210 having first and second flexures 215 similar to that of FIGS. 3A–3C above, and having an insulative element 220 that electrically insulates the beam 210 from the contactor 230 provided on a bottom end surface of the insulator and which confronts drain contact 141. The distal end of the beam 210 opposite to the mounting end containing the flexures 215, has one or more notches or recesses 212 which serve a locking elements for the material of the insulative element 220 surrounding the end of the beam. In the illustrated embodiment notches 212 are provided on three end edges of the beam to securely engage the surrounding insulative material of element 220. The insulative element is formed during the process of manufacturing the relay, and typically comprises polyamide, PMMA or other suitable insulating material known in the art.

In operation, when a threshold electric field is established between the gate 130 and the beam 210 (through source contact 120), the beam 210 is deflected downwardly and allows the contactor 230 to complete an electrical connection between the two drain contacts 140 and 141. Thus, the insulative element 220 permits the actuation of the relay independently of the drain contacts 140, 141. Since the elements of the switch that manipulate the beam do not come into physical contact and are electrically insulated from the contactor 230 that governs electrical communication between the two drain contacts 140 and 141, the functions of actuation and contact are separated.

As mentioned above, the advantage of an isolated contactor 230 such as described herein is that the current being switched does not alter the fields used to actuate the relay. During operation, contact made between the isolated contactor 230 and the drain contacts 140, 141 is not affected or influenced by the current flowing in the beam 210. Thus, the isolated contactor 230 completes a circuit independently from the circuitry used to actuate the relay. Additionally, the contactor 230 can be fabricated from a different conductive material than the beam 210.

Figure 6A:
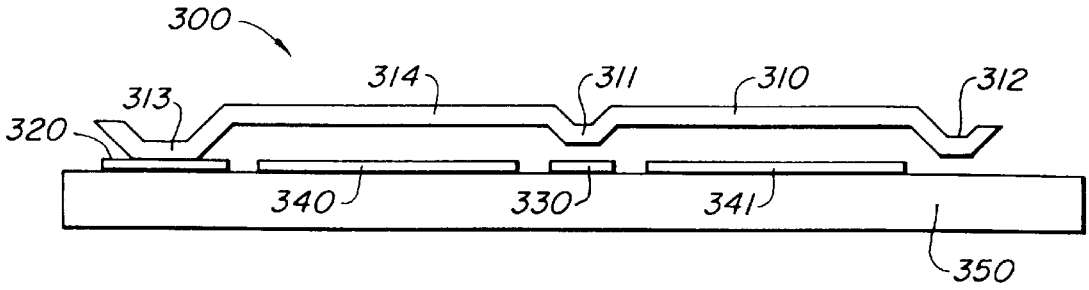
FIG. 6A is a side view of a further embodiment of a micromechanical switch invention in a deactivated state.
Figure 6B:
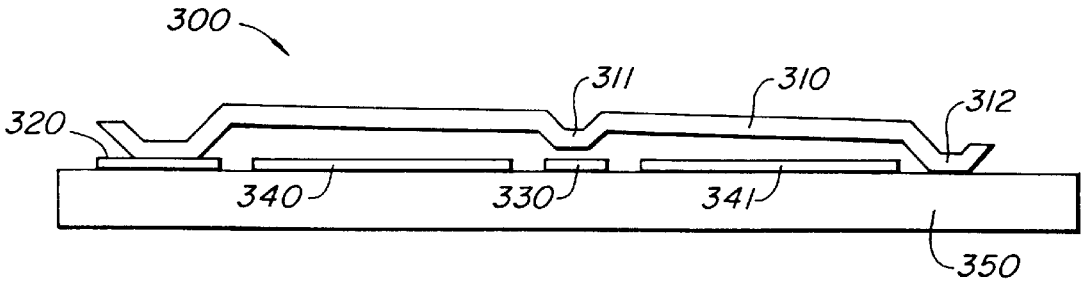
FIG. 6B is a side view of the switch of FIG. 6A between the inactivated state and the fully activated state.
Figure 6C:
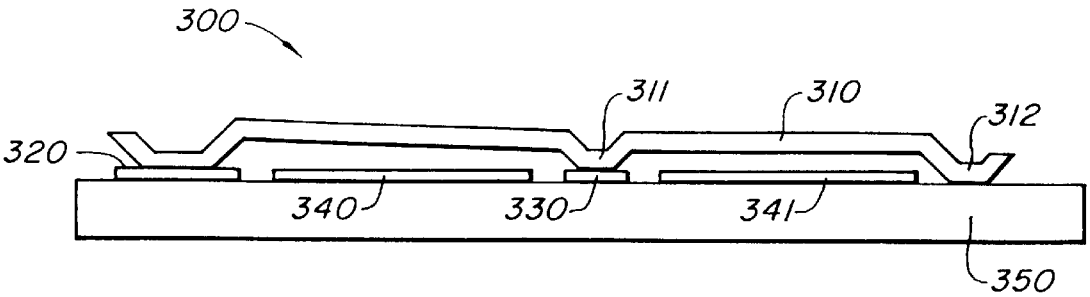
FIG. 6C is a side of the switch of FIG. 6A in a fully activated state.

Referring now to FIGS. 6A–6C a snap action micromechanical switch 300 is presented. The switch 300 includes a beam 310 which is connected at a first end 313 to a source contact 320. Beam 310 includes a central section 311 adapted to contact a drain contact 330, and a distal end section 312. A pair of gate contacts 340, 341 are used to establish an electrostatic field for deflecting the beam 310 towards the contacts.

In FIG. 6A the switch 300 is shown in its deactivated state, wherein an electrostatic field of a first intensity has been established. In this state the central section 311 and end section 312 of beam 310 are overhanging and isolated from the substrate 350 and drain contact 330. In FIG. 6B an electrostatic field of a second intensity has been established between beam 310 and gate contacts 340, 341 resulting in beam 310 being deflected downwards to a first position towards contacts 330, 340, 341 such that the distal end section 312 of the beam 310 is in physical contact with the substrate 350, halting further motion of the beam 310. At this point, since the beam 310 is rigidly supported by the source contact 320 at one end and simply supported by the substrate 350 at the other end, the beam is functioning as a leaf spring. As shown in FIG. 6C, a further increase in the electrostatic field intensity between the gate electrodes 340, 341 and the beam 310 results in central portion 311 of the beam being drawn closer to the drain contact 330, with central portion 311 eventually making mechanical and electrical contact with the drain contact 330. This formation of a leaf spring type structure is useful in ensuring that the beam will return to its original state (FIG. 6A) after the electrostatic field established between the gate electrodes 340, 341 and beam 311 has been decreased or removed. This embodiment also provides an additional advantage over prior art switches in that, due to processing difficulties, the beam end section 312 may be down after formation. However, even if the device is formed as such, the device is still functionable since the central portion of the beam is still deflectable.

Figure 7A:
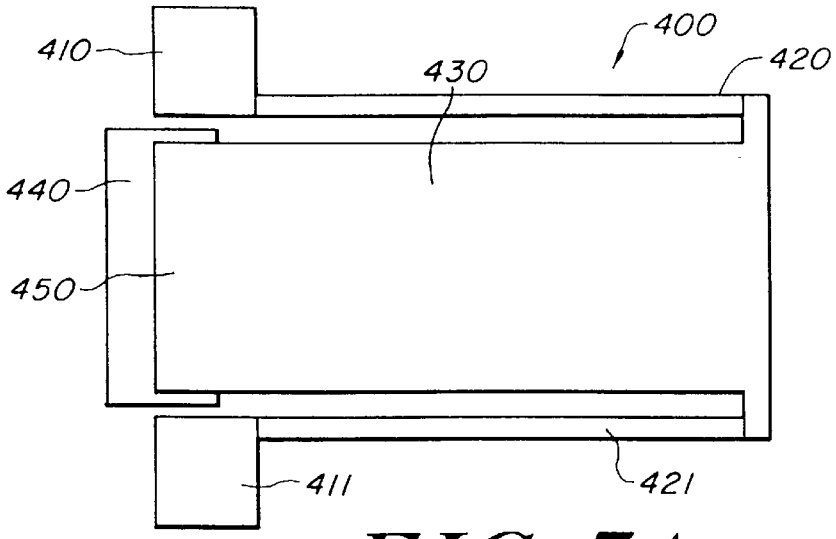
FIG. 7A is a top view of a low voltage switch in which the source contacts are in parallel with the drain contacts.
Figure 7B:
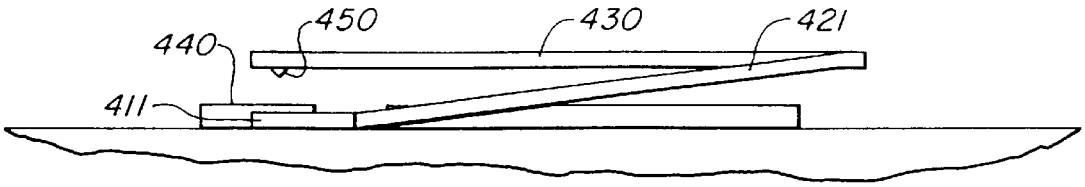
FIG. 7B is a side view of the device of FIG. 7A.
Figure 7C:
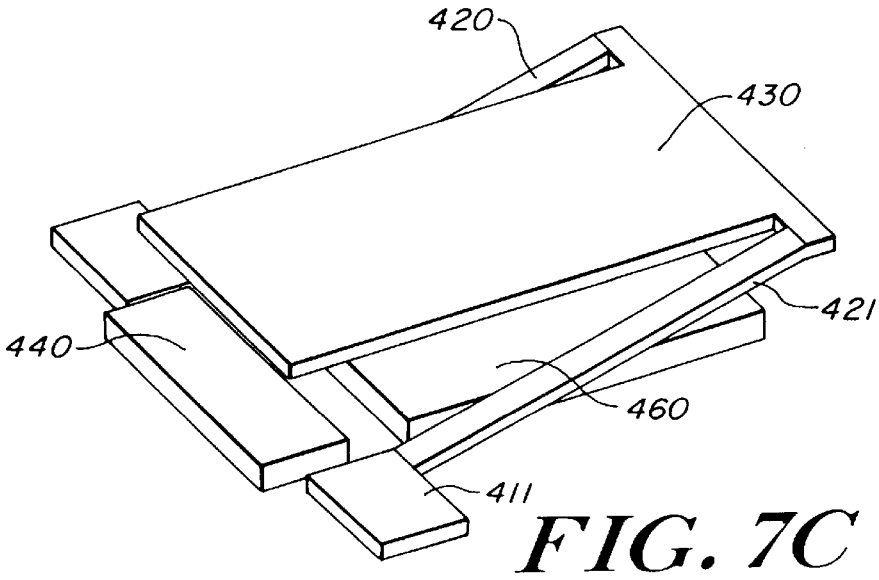
FIG. 7C is an isometric view of the device of FIG. 7A.

Referring now to FIGS. 7A–7C, a version 400 of the micromechanical switch or relay is shown which is configured to be operable at a very low voltage. A benefit of this embodiment is that the effects associated with the strain gradient of the mechanical beam material (nickel or other material) are reduced because the source contacts 410, 411 are configured to be collinear with the drain contact 440. Long rectangular support sections 420, 421 extend from a beam fixed end to the source contacts 410, 411 and support the beam plate 430 above, and run generally parallel to, a gate electrode 460. Beam plate 430 is folded back toward the drain contact and includes a contact area 450 for making contact with drain contact 440. When an electrostatic field of sufficient intensity is established between the gate electrode 460 and the beam plate 430, beam plate 430 is drawn downward and contact area 450 makes electrical and mechanical contact with drain contact 440. In an alternate embodiment, a low voltage relay is obtained by insulting the contact area 450 from the beam plate 430 and having the contact area provide communication between two drain contacts through the contact area 450. In operation, the beam plate 430 stays generally coplanar with respect to the gate electrode 460, and the rectangular support sections 420, 421 are deformed when the beam plate 430 is drawn downward by the electrostatic field established between the gate electrode 460 and the beam plate 430. The rectangular support sections 420, 421 are also useful in restoring beam plate 430 to its original deactivated position.

Figure 8A:
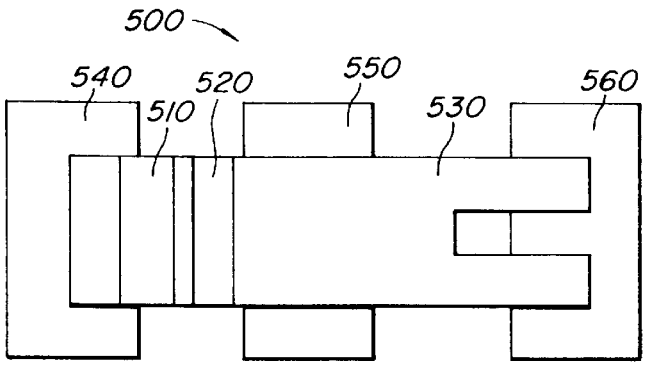
FIG. 8A is a top view of a hinged beam switch.
Figure 8B:
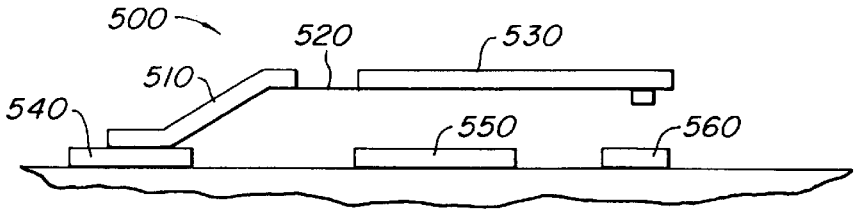
FIG. 8B is a side view of the switch of FIG. 8A in a deactivated state.
Figure 8C:
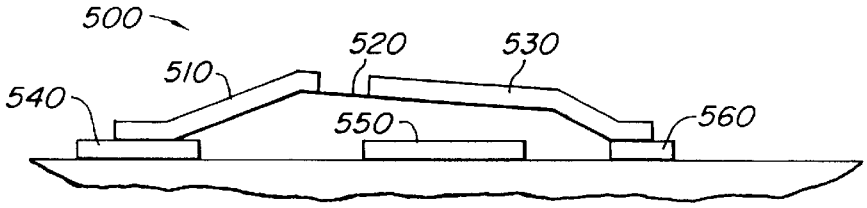
FIG. 8C is a side view of the switch of FIG. 8A in an activated state.

A further embodiment is shown in FIGS. 8A–8C which incorporates a hinge as part of the beam body. The hinged beam switch 500 includes a beam having a first beam section 510, a second beam section 530, and a hinge 520 connected between the first beam section and the second beam section. A first end of the first beam section 510 is attached to a source contact 540, and the second end of the first beam section 510 is attached to a first end of hinge 520. Hinge 520 is comprised of a thin layer of conductive material. The second end of hinge 520 is connected to a first end of second beam section 530. The second end of second beam section 530 overhangs drain electrode 560. In operation, when a strong enough electrostatic force is generated between the second beam section 530 and the gate electrode 550, the second beam section 530 is deflected downwardly, beginning to slope at the hinge while first section 520 remains relatively stationary. Accordingly, since hinge 520 has a much smaller cross-sectional area, the second section 530 of the beam is more easily deflectable than a conventional beam. In an additional embodiment, a relay is formed by isolating the end of second beam section 530 from the second beam section 530, and having the end section interconnect a pair of drain contacts.

Figure 9:
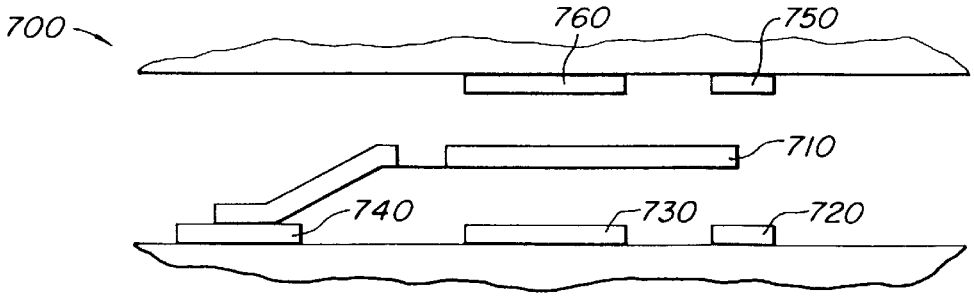
FIG. 9 is a side view of the single pole, double throw switch.

Shown in FIG. 9 is a further embodiment, a single pole double throw (SPDT) device 700. The SPDT device 700 includes a beam 710 which is deflectable in a first direction from an inactive state to a first active state when a strong enough electrostatic field is established between first gate electrode 730 and beam 710 such that the end of beam 710 makes electrical and mechanical contact with first drain electrode 720. Further, the beam is deflectable in a second direction from the inactive state to a second active state when a strong enough electrostatic field is established between second gate electrode 760 and beam 710 such that the end of beam 710 provides secure electrical and mechanical contact between the beam tip and the second drain electrode 750. While a hinged beam is shown, it should be appreciated that any style beam could be utilized. An SPDT relay could also be utilized by insulating the beam tip from the beam body, and having the beam tip interconnect a pair of drain electrodes in each direction.

In order for these small physical sized devices to handle high current switching, the switches or relays may be ganged together. By ganging the devices, the contact resistance of one device is in parallel with all the other ganged devices, thus the contact resistance of the ganged device as a whole is reduced. As an example, if a single device has a contact resistance of 110 milliOhms, a gang of eleven devices would have a contact resistance as a whole of 10 milliOhms. Of the utmost importance in the ganged device is the assurance that all the contacts are made or broken simultaneously such that currents are shared between all the switches. Operation of the ganged device wherein the contacts are not made or broken simultaneously may result is catastrophic failure of the ganged device.

Referring to FIGS. 10A and 10B, two different style ganged switches are shown. In FIG. 10A a source electrode comprising a plurality of individual source contacts 830 are shown. A plurality of beams 840 are shown, one for each source contact, and are attached at their first ends to a respective source contact 830, have their beam body overhanging a respective gate contact 810 and have their tip overhanging a respective drain contact 820. A gate electrode comprising a plurality of gate contacts 810 are shown disposed beneath respective beam bodies. A drain electrode comprising a plurality of drain contacts 820 are electrically and mechanically connected to the respective beam when a large enough electrostatic force is established between the respective gate electrode 810 and respective beam body 840. Shown in FIG. 10B is a similar device except that the electrodes comprise a single large contact. The source electrode 890 is a single large contact equivalent to the several individual contacts 830 shown in FIG. 10A. Similarly, the gate electrode 860 is a single large gate contact, and the drain electrode 880 is a single large drain contact. A single beam 870 is also utilized. There could also be various combinations of the contacts of FIGS. 10A and 10B. For example, a ganged switch device could comprise a plurality of source contacts, a single large gate electrode, a single large beam and a plurality of drain contacts. Other combinations are also contemplated depending on the performance desired.

Individual contacts of a ganged switch or relay may fail at high currents. In order to maximize the current carrying capacity of a ganged switch or relay, a plurality of series resistors are incorporated into the switch or relay. The series resistors are used to equalize the amount of current flowing through each contact. Referring now to FIG. 10C, a ganged switch 895 is shown which includes the series resistors. The switch 895 is similar to the switch of FIG. 10B, in that the switch includes a single large gate electrode 860, a single large source electrode 890, and a 10 single large drain electrode 880. Also included are a plurality of series resistors 891, one per beam finger. In operation, when the switch is activated, the beam contacts a first end of each resistor, while the second end of each resistor is fixed in mechanical and electrical communication with the drain electrode. Alternately, the resistors could be integrated as part of the beam structure wherein a first end of the resistor is fixed in mechanical and electrical communication with the beam and the second end is in contact with the drain electrode when the switch is activated.

In general, it is desirable to have the switch or relay continue to operate at voltages as far in excess of the threshold voltage of the device as possible. The device thus has a wider operating voltage range, simplifying the design of circuits utilizing the device. Further, the manufacturer has a wider process latitude and the force applied to the contacts is larger.

Figure 11A:
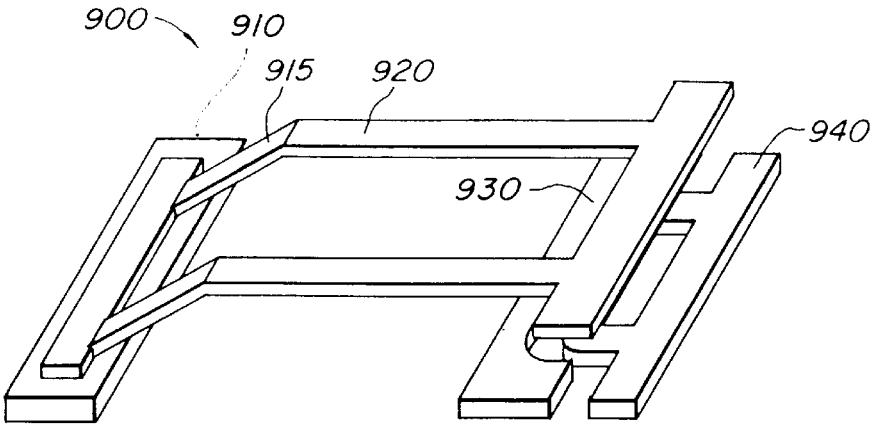
FIG. 11A is an isometric view of an increased overvoltage factor switch.
Figure 11B:
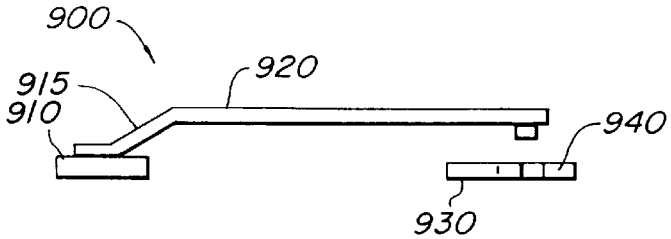
FIG. 11B is a side view of the switch of FIG. 11A.
Figure 11C:
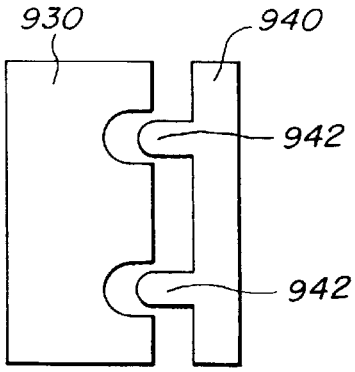
FIG. 11C is a top view of the gate/drain contacts of the switch of FIG. 11A.

An overvoltage factor is defined as the ratio between the voltage at which the beam is pulled down into contact with the gate (causing the device to malfunction) and the threshold voltage of the device. The overvoltage factor can be increased by implementing a few design features, as shown in the device 900 of FIGS. 11A–11C. First, the main part of the beam 920 is made very rigid as compared with the flexure 915, with the rigidity of the main part of the beam 920 acting to prevent contact with the gate electrode 930 and the portion of the main part of the beam 920 extending from the source contact 910 is made narrower or split into two parts as shown. An additional increase in the overvoltage factor is achieved by positioning the gate electrode 930 near the distal end of the beam proximate to the drain electrode 940, and by moving the drain contacts 942 into the area defined by the gate electrode 930. Both of these features decrease the force acting near the center of the beam as compared with having the force acting nearer the contacts thus improving the overvoltage factor of the device.

The leads of the switches or relays are designed to have relatively low resistance. Using gold metallization, the sheet resistivity of the gold metallization is approximately 1 Ohm/square. These devices thus have a total resistance of approximately two ohms. For the largest switches or relays, the power consumption of the device is expected to be approximately 10 Watts. At this power level, the device will be dissipating excessive amounts of heat and will likely degrade rapidly. One manner of overcoming this limitation is to reduce the sheet resistance of the gold metallization by increasing the thickness of the gold. By increasing the gold metallization layer to one micron from the standard 0.1 micron, the switch resistance would be reduced from approximately 2.0 Ohms to about 0.2 Ohms, with a concomitant decrease in power dissipation to about one watt. Further reductions can be achieved by using a greater metallization thickness by way of a more conformal sacrificial layer deposition, such as by Chemical Vapor Deposition or by plating (Electroless or Electroplating); or by increasing the thickness of the gold metallization everywhere except beneath the contacts.

The performance and operation of the switches and relays of the present invention are based on the mechanical properties of the beam material and the electrostatic forces generated between the beam and the gate. The deflection of the beam $v_o$ due to a force W applied at the end of the beam may be expressed by the equation:

$$v_o = \frac{-Wl^3}{3E'I} \tag{1}$$

where:

W is the applied load; 1 is the length of the cantilever; E' is the Effective Young's modulus; and I is the moment of inertia.

Combining equation (1) with moment of inertia for a rectangular beam gives the following equation for the lumped spring constant of the beam:

$$k = \frac{bh^3E'}{4l^3} \tag{2}$$

The structure of the beam and the underlying substrate approximate the parallel plates of a capacitor. The force between two parallel plates of a capacitor (ignoring fringing fields) can be expressed as:

$$F_E = \varepsilon_o A \frac{V^2}{2d^2}$$

where:

d is the initial spacing between the electrodes; $\epsilon_o$ is the permittivity of free space; A is the area of one of the plates; and V is the applied voltage.

The force exerted by the electric field is counteracted by the spring force of the beam such that $$kv_o = \varepsilon_o A \frac{V^2}{2[d - v_o]^2}. \quad (4)$$

As a simple approximation, the electrostatic force is assumed to act solely on the end of the beam. This leads to the relationship between the voltage and the position $$V=[d-v_o]^* \sqrt{2kv_o/\epsilon_o A} \quad (5)$$

For small $v_o$, the voltage required to hold a proof mass in position varies approximately as the square root of the distance. As the position increases, the voltage required to hold the proof mass increases monotonically, but at an ever decreasing rate. At a certain point d', the slope dV/dx is zero. Further increases in the position require less holding voltage. Therefore, if the position were to increase beyond d', at a fixed voltage, the proof mass would continue to be accelerated until the force plates of the capacitor met. Therefore, for voltages above the maximum value ($V_{th}$) the system is unstable and the force plates collapse.

The threshold voltage $V_{the}$ may be expressed as:

$$V_{th} = \frac{2}{3} d * \sqrt{2\frac{kd}{\varepsilon_o A}}. \quad (6)$$

The example here is for a rectangular beam. However, other more complex beam shapes could be conceived in which the force plate area is increased independently of the spring geometry. The gate capacitance and the threshold voltage are intimately coupled just as in a field effect transistor (FET), but the gap spacing which correlates to the gate oxide thickness cannot be completely absorbed into the capacitance term. Compared to FETs, the gate capacitance can be 100 to 500-fold smaller, and can be as much as 1000-fold smaller. In this case, $$V_{th} = \frac{2}{3} d * \sqrt{\frac{2k}{C_{gate}}} \quad (7)$$

The preferred method of making the micromechanical switches or relays of the invention is micromachining. Micromachining involves the use of planar technology, wet chemical etching, metallization and metal deposition in order to fabricate mechanical devices which are smaller, more efficient and capable of large scale production at low cost as compared to other mechanical device manufacturing techniques.

An exemplary device made by the methods according to the invention features a beam length of 65 $\mu$m, a beam width of 30 $\mu$m, a beam thickness of 2.0 $\mu$m and a beam-to-gate spacing of 1.7 $\mu$m. A beam of this size has a resistance of approximately 0.032 ohms. The turn-on voltage for such a device is approximately 100 volts, and the turn-off voltage is between approximately 75–100 volts, depending on the size of the contact tip. A device with these parameters has an operational frequency of approximately 300 kHz.

The devices of the present invention have broad uses. The micromechanical switch or relay of the present invention may be used as a memory element, or in applications where use of a small contact area relative to the gate area to enhance contact pressure is required. The device can be micromachined as a small unit to compete with microelectronics. The device is also capable of high speed performance.

Figure 12:
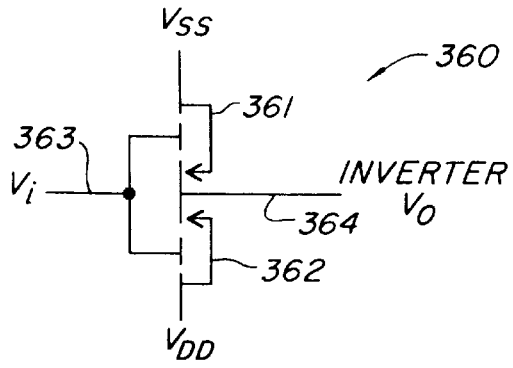
FIG. 12 is a circuit schematic of an inverter using micromechanical devices.
Figure 13:
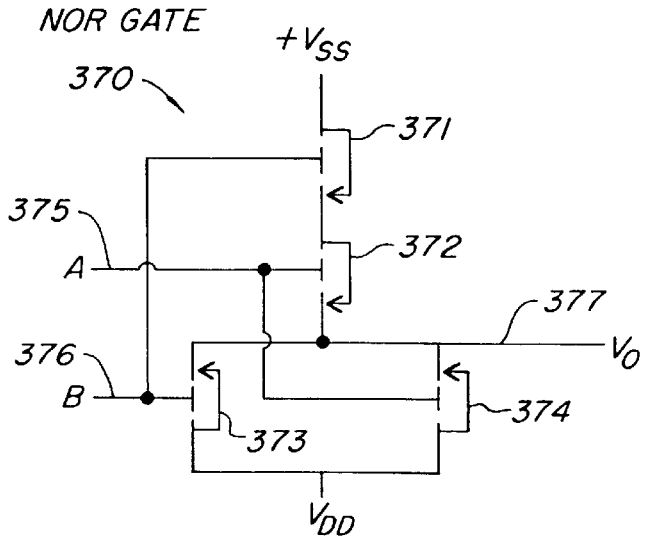
FIG. 13 is a circuit schematic of a NOR gate using micromechanical devices.
Figure 14:
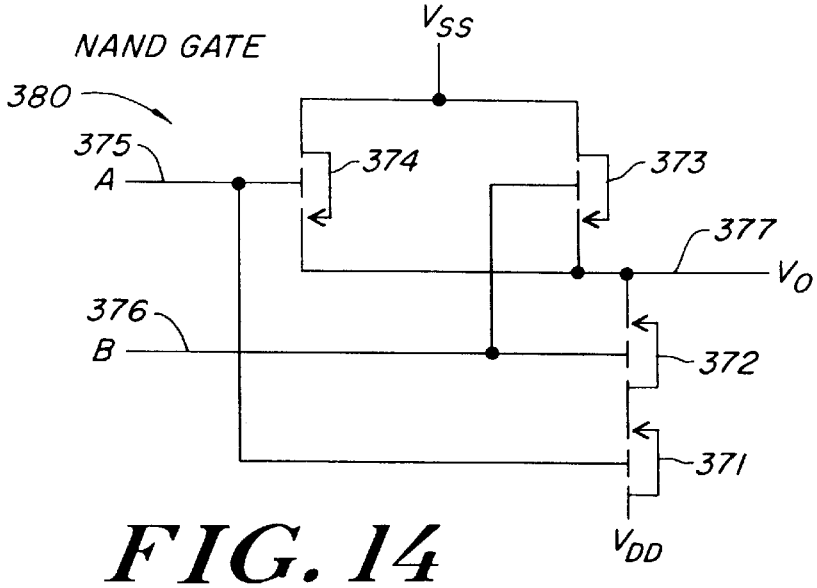
FIG. 14 is a circuit schematic of a NAND gate using micromechanical devices.

FIGS. 12–14 show the use of the micromechanical switch or relay as elements of logic gates. FIG. 12 shows an inverter 360 utilizing two micromechanical switches 361 and 362. A low voltage or ground on the switch input 363 results in first switch 361 remaining in an open state and second switch 362 becoming activated, such that the $V_{dd}$ is connected through switch 362 to the inverter output 364. When the input 363 has a voltage high enough, switch 362 is deactivated and switch 361 is activated, connecting the $V_{ss}$ through switch 361 to the inverter output 364.

Referring now to FIG. 13 a NOR gate 370 is implemented using four micromechanical devices 371–374. In operation, only when inputs 375 and 376 are both at a low voltage or ground, are devices 371 and 372 activated such that the $V_{ss}$ is connected to the output 377 through devices 371 and 372. If input 375 is at a high enough voltage, $V_{dd}$ will be provided at output 377 through device 374 while device 372 will be inactive, and if input 376 is at a high enough voltage device 373 will be activated providing $V_{dd}$ at output 377, while device 371 is deactivated. If both inputs are high, devices 373 and 374 will be activated thereby providing $V_{dd}$ at the output 377 while devices 371 and 372 are inactive.

FIG. 14 shows a NAND gate implemented in four micromechanical devices. The circuit of FIG. 14 is similar to the circuit of FIG. 13, except that the $V_{ss}$ and $V_{dd}$ supplies have been swapped. In operation, only when inputs 375 and 376 are both at a high enough voltage are devices 371 and 372 activated such that $V_{dd}$ is connected to the output 377 through devices 371 and 372. If input 375 is at a low enough voltage $V_{ss}$ will be provided at output 377 through device 374 while device 372 will be inactive, and if input 376 is at a low enough voltage device 373 will be activated providing $V_{ss}$ at output 377, while device 371 is deactivated. If both inputs are low, devices 373 and 374 will be activated, presenting $V_{ss}$ to the output 377, while devices 371 and 372 will be inactive. While only a few logic circuits are shown, it should be appreciated that a large variety of logic circuits could be built as well using various configurations and quantities of the micromechanical devices.

Although the invention has been shown and described with respect to an illustrative embodiment thereof, it should be appreciated that the foregoing and various other changes, omissions, and additions in the form and detail thereof may be made without departing from the spirit and scope of the invention as delineated in the claims.

What is claimed is:

1. A micromechanical switch comprising:

a substrate;

a source electrode mounted on said substrate;

a gate electrode mounted on said substrate;

a drain electrode mounted on said substrate; and a beam comprising:

a conductive beam body having a first end and a second end, said first end of said beam body including a pair of flexures attached to said source electrode, said beam body overhanging said gate electrode, wherein said pair of flexures adjusts one physical characteristic of said conducting beam; and said second end of said beam body overhanging said drain electrode, and wherein said second end of said beam body is deflectable from a first position overhanging said drain electrode when an electrostatic field of a first intensity is established between said beam body and said gate electrode, to a second position in which said second end of said beam body is in mechanical and electrical contact with said drain electrode when an electrostatic field of a second intensity is established between said beam body and said gate electrode.

2. The micromechanical device of claim 1, wherein said beam has a length greater than approximately 10 μm.

3. The micromechanical device of claim 1, wherein said beam has a length of approximately 70 μm.

4. The micromechanical device of claim 1, wherein said micromechanical device is incorporated into a logic circuit.

5. The micromechanical device of claim 1, wherein said micromechanical device has an actuation voltage of approximately 100 volts.

6. The micromechanical device of claim 1, wherein said micromechanical device is switched at a frequency of approximately 300 kHz or less.

7. A micromechanical relay comprising:

a substrate;

a source electrode mounted on said substrate;

a gate electrode mounted on said substrate;

a pair of drain contacts mounted on said substrate; and a beam comprising:

a conductive beam body having a first end, a second end, and an insulator disposed between said first end and said second end, said first end of said beam body including a pair of flexures attached to said source electrode, wherein said pair of flexures adjusts one physical characteristic of said conducting beam, said beam body overhanging said gate electrode, said second end of said beam body overhanging said drain contacts and wherein said second end of said beam body is deflectable from a first position overhanging said drain contacts when an electrostatic field of a first intensity is established between said beam body and said gate electrode, to a second position in which said second end of said beam body is in mechanical and electrical contact with said drain contacts when an electrostatic field of a second intensity is established between said beam body and said gate electrode.

8. The micromechanical device of claim 7, wherein said beam has a length greater than approximately 10 μm.

9. The micromechanical device of claim 7, wherein said beam has a length of approximately 70 μm.

10. The micromechanical device of claim 7, wherein said micromechanical device is incorporated into a logic circuit.

11. The micromechanical device of claim 7, wherein said micromechanical device has an actuation voltage of approximately 100 volts.

12. The micromechanical device of claim 7, wherein said micromechanical device is switched at a frequency of approximately 300 kHz or less.

13. A micromechanical relay comprising:

a substrate;

a source electrode mounted on said substrate;

a gate electrode mounted on said substrate;

a pair of drain contacts mounted on said substrate; and a beam comprising:

a conductive beam body having a first end, a second end, and an insulator disposed between said first end and said second end, said beam body including at least one recess and said insulator filling said recess for providing a secure mechanical connection of said insulator to said beam body, said first end of said beam body attached to said source electrode, said beam body overhanging said gate electrode, said second end of said beam body overhanging said drain contacts and wherein said second end of said beam body is deflectable from a first position overhanging said drain contacts when an electrostatic field of a first intensity is established between said beam body and said gate electrode, to a second position in which said second end of said beam body is in mechanical and electrical contact with said drain contacts when an electrostatic field of a second intensity is established between said beam body and said gate electrode.

14. The micromechanical device of claim 13, wherein said beam has a length greater than approximately 10 μm.

15. The micromechanical device of claim 13, wherein said beam has a length of approximately 70 μm.

16. The micromechanical device of claim 13, wherein said micromechanical device is incorporated into a logic circuit.

17. The micromechanical device of claim 13, wherein said micromechanical device has an actuation voltage of approximately 100 volts.

18. The micromechanical device of claim 13, wherein said micromechanical device is switched at a frequency of approximately 300 kHz or less.

19. A micromechanical switch comprising:

a substrate;

a source electrode mounted on said substrate;

a first gate contact and a second gate contact mounted on said substrate;

a drain electrode mounted on said substrate; and a beam comprising:

a conductive beam body having a first end, a first section, a center portion, a second section, and a second end, said first end of said beam body attached to said source electrode, said first section overhanging said first gate contact, said center portion overhanging said drain electrode, said second end overhanging and extending beyond said second gate contact; and wherein said beam body is deflectable from a first position overhanging said drain electrode when an electrostatic field of a first intensity is established between said beam body and said first and second gate contacts, to a second position in which said center portion of said beam body is in mechanical and electrical contact with said drain electrode when an electrostatic field of a second intensity is established between said beam body and said first and second gate contacts.

20. The micromechanical device of claim 19, wherein said beam has a length greater than approximately 10 μm.

21. The micromechanical device of claim 19, wherein said beam has a length of approximately 70 μm.

22. The micromechanical device of claim 19, wherein said micromechanical device is incorporated into a logic circuit.

23. The micromechanical device of claim 19, wherein said micromechanical device has an actuation voltage of approximately 100 volts.

24. The micromechanical device of claim 19, wherein said micromechanical device is switched at a frequency of approximately 300 kHz or less.

25. A micromechanical switch comprising:

a substrate;

a first source electrode and a second source electrode mounted on said substrate;

a gate electrode mounted on said substrate;

a drain electrode mounted on said substrate, said first and second source electrodes disposed at opposite ends of said drain electrode so as to be collinear with said drain electrode; and a beam comprising:

a conductive beam body having a first end, a beam plate, and a second end, said first end of said beam body attached to said first source electrode through a first rectangular support section extending from said first end of said beam body along a first side of said gate electrode to said first source electrode and attached to said second source electrode through a second rectangular support section extending from said first end of said beam body along an opposite side of said gate electrode to said second source electrode, said beam plate overhanging said gate electrode, said second end having a contact area overhanging said drain electrode; and wherein said beam body is deflectable from a first position overhanging said drain electrode when an electrostatic field of a first intensity is established between said beam body and said gate electrode, to a second position in which said contact area of second end of said beam body is in mechanical and electrical contact with said drain electrode when an electrostatic field of a second intensity is established between said beam body and said gate electrode.

26. The micromechanical device of claim 25, wherein said beam has a length greater than approximately 10 $\mu$m.

27. The micromechanical device of claim 25, wherein said beam has a length of approximately 70 $\mu$m.

28. The micromechanical device of claim 25, wherein said micromechanical device is incorporated into a logic circuit.

29. The micromechanical device of claim 25, wherein said micromechanical device has an actuation voltage of approximately 100 volts.

30. The micromechanical device of claim 25, wherein said micromechanical device is switched at a frequency of approximately 300 kHz or less.

31. A micromechanical relay comprising:

a substrate;

a first source electrode and a second source electrode mounted on said substrate;

a gate electrode mounted on said substrate;

a pair of drain contacts mounted on said substrate, said first and second source electrodes disposed at opposite sides of said drain contacts so as to be collinear with said drain contacts; and a beam comprising:

a conductive beam body having a first end, a beam plate, a second end, and an insulator disposed between said first end and said second end of said beam body, said first end of said beam body attached to said first source electrode through a first rectangular support section extending from said first end of said beam body along a first side of said gate electrode to said first source electrode and attached to said second source electrode through a second rectangular support section extending from said first end of said beam body along an opposite side of said gate electrode to said second source electrode, said beam plate overhanging said gate electrode, said second end having a contact area overhanging said drain contacts; and wherein said beam body is deflectable from a first position overhanging said drain contacts when an electrostatic field of a first intensity is established between said beam body and said gate electrode, to a second position in which said contact area of second end of said beam body is in mechanical and electrical contact with said drain contacts when an electrostatic field of a second intensity is established between said beam body and said gate electrode.

32. The micromechanical device of claim 31, wherein said beam has a length greater than approximately 10 $\mu$m.

33. The micromechanical device of claim 31, wherein said beam has a length of approximately 70 $\mu$m.

34. The micromechanical device of claim 31, wherein said micromechanical device is incorporated into a logic circuit.

35. The micromechanical device of claim 31, wherein said micromechanical device has an actuation voltage of approximately 100 volts.

36. The micromechanical device of claim 31, wherein said micromechanical device is switched at a frequency of approximately 300 kHz or less.

37. A micromechanical switch comprising:

a substrate;

a source electrode mounted on said substrate;

a gate electrode mounted on said substrate;

a drain electrode mounted on said substrate; and a beam comprising:

a conductive beam body having a first end and a second end, said beam body including a hinge disposed between said first end and second end of said beam body, said hinge being thinner and having a smaller cross-sectional area than said first and second ends of said beam body, said first end of said beam body attached to said source electrode, said beam body overhanging said gate electrode, said second end of said beam body overhanging said drain electrode, and wherein said second end of said beam body is deflectable from a first position overhanging said drain electrode when an electrostatic field of a first intensity is established between said beam body and said gate electrode, to a second position in which said second end of said beam body is in mechanical and electrical contact with said drain electrode when an electrostatic field of a second intensity is established between said beam body and said gate electrode.

38. The micromechanical device of claim 37, wherein said beam has a length greater than approximately 10 $\mu$m.

39. The micromechanical device of claim 37, wherein said beam has a length of approximately 70 $\mu$m.

40. The micromechanical device of claim 37, wherein said micromechanical device is incorporated into a logic circuit.

41. The micromechanical device of claim 37, wherein said micromechanical device has an actuation voltage of approximately 100 volts.

42. The micromechanical device of claim 37, wherein said micromechanical device is switched at a frequency of approximately 300 kHz or less.

43. A micromechanical switch comprising:

a substrate;

a source electrode mounted on said substrate;

a gate electrode mounted on said substrate;

a drain electrode mounted on said substrate such that said drain electrode and said gate electrode are adjacent; and a beam comprising:

a conductive beam body having a first end and a second end, the first end connected to said source electrode; and said second end of said beam body overhanging said drain electrode and said gate electrode, and wherein said second end of said beam body is deflectable from a first position overhanging said drain electrode when an electrostatic field of a first intensity is established between said beam body and said gate electrode, to a second position in which said second end of said beam body is in mechanical and electrical contact with said drain electrode when an electrostatic field of a second intensity is established between said beam body and said gate electrode.

44. The micromechanical switch of claim 43 wherein said first end of said beam body comprises a pair of flexures attached to said source electrode.

45. The micromechanical switch of claim 43 wherein said beam body further comprises a center portion, and further wherein said first end of said beam body comprises a first pair of flexures attached to said source electrode, said center portion of said beam body comprises a second pair of flexures, and said second end of said beam body comprises a bar connecting said second pair of flexures.

* * * * *